US006694899B2

(12) United States Patent
Kukin et al.

(10) Patent No.: US 6,694,899 B2
(45) Date of Patent: Feb. 24, 2004

(54) USE OF EXPANDED AGENTS FOR MINIMIZING CORROSION AND BUILD-UP OF DEPOSITS IN FLUE-GAS SYSTEMS

(75) Inventors: Ira Kukin, West Orange, NJ (US); William Carmen Pepe, Stanhope, NJ (US)

(73) Assignee: Apollo Technologies International Corp., Livingston, NJ (US)

( * ) Notice: Subject to any disclaimer, the term of this patent is extended or adjusted under 35 U.S.C. 154(b) by 218 days.

(21) Appl. No.: 09/814,598

(22) Filed: Mar. 23, 2001

(65) Prior Publication Data

US 2002/0170475 A1 Nov. 21, 2002

(51) Int. Cl.[7] ..... F23B 7/00
(52) U.S. Cl. ..... 110/343; 110/203; 110/233
(58) Field of Search ..... 44/600; 208/47, 208/48 R; 110/342, 343, 344, 203, 233; 423/210, 269, 243.05; 502/410

(56) References Cited

U.S. PATENT DOCUMENTS 3,249,075 A * 5/1966 Nelson et al. ..... 110/1
4,369,719 A * 1/1983 Engstrom et al. ..... 110/345
4,458,606 A * 7/1984 Merrell ..... 110/343
4,498,402 A * 2/1985 Kober et al. ..... 110/345
4,577,566 A * 3/1986 Merrell ..... 110/343
4,829,036 A * 5/1989 Nelson et al. ..... 502/50
4,842,617 A 6/1989 Kukin
5,034,114 A 7/1991 Kukin
5,339,755 A * 8/1994 Smith ..... 110/345
5,346,674 A * 9/1994 Weinwurm et al. ..... 422/168

* cited by examiner

*Primary Examiner*—Ira S. Lazarus
*Assistant Examiner*—K B Rinehart
(74) *Attorney, Agent, or Firm*—Harold James; Robert L. Epstein; James & Franklin, LLP

(57) ABSTRACT

A method for minimizing corrosion and the build-up of deposits on surfaces of a flue-gas system exposed to moist substances and elevated temperatures, and particularly those surfaces which are used to convey other additives to the system and the surfaces of gas/gas heaters which receive the output from scrubbers, which method involves adding to the system, particularly in those conduits and at the surfaces of the gas/gas heater, generally inert bulking agents such as perlite and vermiculite in expanded form, such agents, apparently by acting under the operating conditions to which they are subjected to retain substantial quantities of water without becoming dissolved, accomplishing the desired results.

2 Claims, 1 Drawing Sheet

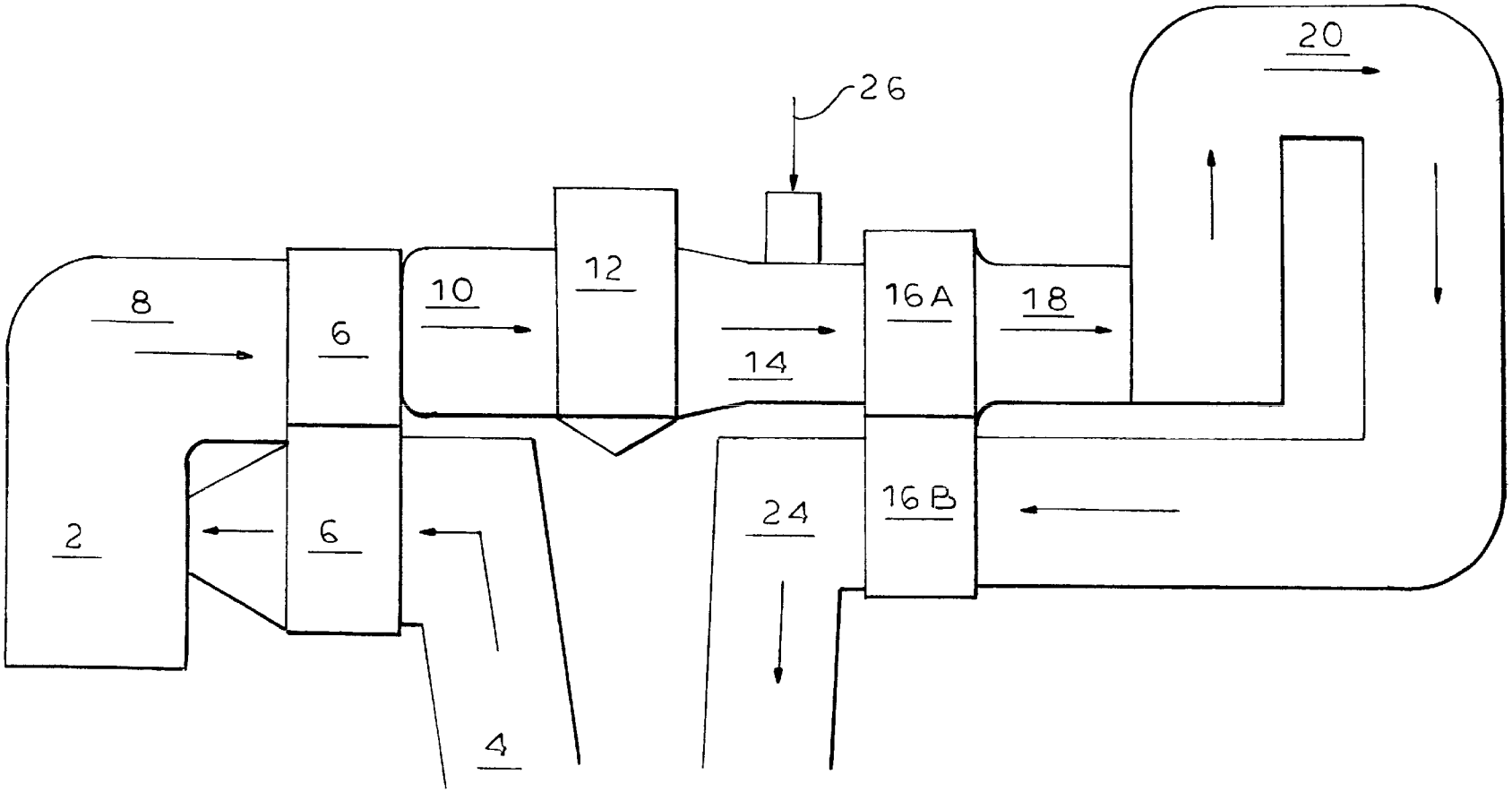
20
18
16A
16B
26
14
24
12
10
4
6
6
8
2

USE OF EXPANDED AGENTS FOR MINIMIZING CORROSION AND BUILD-UP OF DEPOSITS IN FLUE-GAS SYSTEMS

The present invention relates to a method to minimize corrosion and particularly build-up in sections, including associated feed conduits, of a flue-gas system where significant amounts of moisture and/or sulfuric acid are present.

BACKGROUND OF THE INVENTION

In most flue-gas systems, for safety and environmental reasons, as a means of conserving heat, the flue-gas leaving the furnace at relatively high temperatures is passed through a variety of treatment devices before escaping into the atmosphere. Among these devices are, usually in sequence, a boiler or heater, a precipitator, a gas/gas heater, and a scrubber, the flue-gas returning to the gas/gas heater on its way to the stack. The temperature of the flue-gas decreases as the gas passes through the system, and in the course of that temperature decrease moisture, as water and often as sulfuric acid, comes into being. It has long been customary to add substances to the flue-gas to minimize or prevent corrosion of the exposed surfaces of the system. (My prior U.S. Pat. No. 4,842,617 of Jun. 27, 1989 entitled "Combustion Control By Addition of Magnesium Compounds of Particular Particle Sizes", and U.S. Pat. No. 5,034,114 of Jul. 23, 1991 entitled "Acid Neutralizing Composition Additive With Detergent Builder" are representative of the use of such additives.) The corrosive action of sulfuric acid on exposed surfaces of the system is obviously undesirable and it is therefore common to add such substances as limestone or magnesium oxide to the system to neutralize the sulfuric acid. Because a solid/liquid reaction rate is generally slow, relatively large amounts of such additives must be provided. They are usually pneumatically injected into the affected portion of the system through conduits, usually in the form of pipes, using pressurized air as the vehicle to transport the additives through the conduit to the injection location in the system. The act of compressing air generates both heat and moisture, and hence the pressurized air which does the conveying is usually both moisture-laden and hot. Movement of the pressurized additive through the conduits results in some condensation of the moisture on the conduit surface and this enhances the tendency of the solid additives to stick to and build-up on those surfaces. As a result it is periodically necessary to take the injection equipment off line for cleaning, a process which is itself costly and time consuming, and while the injection equipment is off line no anti-corrosion additive is fed to the system, thus increasing the likelihood of corrosion.

When the system is provided with a scrubber the flue-gas emanating from the scrubber has a comparatively high moisture content and a comparatively low temperature, thus leading to the condensation of comparatively large volumes of moisture, significantly including sulfuric acid in its liquid form because its temperature is below its dew point. When, as is usually the case, the output from the scrubber is fed back to the gas/gas heater the moisture content of the flue-gas becomes a significant corrosion-producing factor.

SUMMARY OF THE INVENTION

I have discovered that the build-up of additives such as, typically, limestone or magnesium oxide in the conduits conveying those additives to the system can be significantly reduced and the anti-corrosion effect of the limestone, magnesium oxide or other anti-corrosion additives can be enhanced, by including with the additives, particularly as they are conveyed through their conduit and enter the system, and also importantly while the additives are in the gas/gas heater, relatively small amounts of a generally inert bulking agent in expanded form. Expanded vermiculite and expanded perlite are representative of such substances, which exhibit a crystal structural change to a "popcorn" type expanded material when heated to elevated temperatures, usually of 800° F. or higher, and retaining that expanded characteristic after the high temperature has been reduced. The expansion is normally on the order of 2 to 5 times the original volume.

The precise mechanism by which these expanded materials perform their good offices when thus used in flue-gas systems is not known for certain, but is believed that it is because they may be able to absorb within their interstices substantial quantities of the moisture which is present without congealing or settling out.

Moisture appears to be a factor in forming accumulations of the additive on affected surfaces of a flue-gas system and in particular on the surfaces of the additive feed conduits, and the reduction in the amount of available moisture when the method of the present invention is carried out appears to be responsible for a significant lessening of the conduit build-up, as well as a lessening of corrosion throughout the treated portions of the system.

BRIEF DESCRIPTION OF THE DRAWING

FIG. 1 discloses diagrammatically a typical flue-gas system in which the method of the present invention is particularly useful.

DESCRIPTION OF THE PREFERRED EMBODIMENTS

A typical flue-gas system such as is shown in FIG. 1 comprises a furnace or boiler 2 where steam is generated. Ambient air enters the system at 4 and passes through a primary air heater 6 in which it is heated to perhaps 150° F. and it then enters the furnace 2 to combine with fuel for combustion purposes. A waste product from the combustion in the furnace 2 is the flue-gas which exits the furnace at 8 at a temperature of perhaps 800° F. The flue-gas passes through the air heater 6, providing the means for the initial heating of the ambient air, and the flue-gas which leaves the air heater 6, at 10, will have lost a great deal of its heat and be at a temperature of about 350°–400° F. It then passes into an electrostatic precipitator 12 in which certain impurities are removed, and it escapes from the precipitator 12 at 14 at a further reduced temperature of about 200°–275° F. Because of its reduced temperature the flue-gas may now have a significant moisture content of perhaps 5–15%. The flue-gas then goes into the upper portion 16A of the gas/gas heater 16 from which it escapes to point 18 at a temperature of about 200°–225° F. and it then passes through a scrubber 20 which it leaves at a temperature of perhaps 100°–150° F. and with a moisture content of perhaps as high as 40–50%. The gas is then fed back through the lower portion 16B of the gas/gas heater 16 and escapes through the stack at 24.

The gas/gas heater 16 has structural parts which rotate from the upper portion of 16A to the lower portion of 16B on a continuous basis. It will be apparent that exposed surfaces of the gas/gas heater 16, and particularly those surfaces thereof which at any given moment are in the lower portion 16B of the heater, are very susceptible to acid corrosion because of the high moisture content to which they are subjected. From the point of view of minimizing corrosion in the gas/gas heater 16 it is at the area 14 immediately up-stream of the gas/gas heater 16 where the usual corrosion-minimizing additives are injected into the system, as indicted by the arrow 26.

The susceptibility of the gas/gas heater 16 to corrosion can perhaps be best appreciated by considering that a scrubber 20 more easily and effectively absorbs impurities from the flue-gas when the flue-gas is at or below its dew point, and when the flue-gas exits the scrubber 20 its temperature is below the dew point to an even greater degree, thereby increasing its moisture content and making corrosion more likely. Also, because structural parts of the gas/gas heater 16 rotate sequentially through the upper and lower portions 16A and 16B thereof, they are constantly subjected to variations in temperature, and the constant heating and cooling of the structural parts of the gas-gas heater 16, coupled with the resultant high moisture content of the flue-gas as that passes through the heater, produces a situation ideal for corrosion and for deposit build-up.

Also, as has been pointed out above, the pressurized feeding of the conventional anti-corrosion additive facilitates build-up in the conduit feeding those additives to the system. The additives are preferably injected into the system between the precipitator 12 and the gas/gas heater 16, as indicated by the arrow 26, so that they can perform their desired action where that action is most needed, to wit, in the gas/gas heater 16.

The conventional anti-corrosion additives are usually basifying agents which act to neutralize the acidic constituents, usually sulfuric acid, of the flue-gases. Typically such basifying agents are calcium oxide, calcium hydroxide, calcium carbonate, dolomite, dolomitic lime, lime, calcium hydrate, limestone, magnesium oxide, magnesium hydroxide, magnesium carbonate, potassium or aluminum oxides, hydroxides or carbonates, as well as bicarbonates of each, i.e., calcium, magnesium, potassium or aluminum, as well as combinations thereof such as calcium/magnesium oxides and hydroxides.

Because of the apparent slowness of the reaction between these basifying additives and the sulphur or other oxides that they are designed to neutralize, those additives must be provided in relatively large quantities, well in excess of the stoichiometric amount required to neutralize the acidic constituents. As a result the problem involved in preventing build-up in the conduits through which those basifying agents are fed is intensified.

According to the present invention the build-up problem, particularly in the additive conduit, is significantly improved and the corrosion problem, particularly in the gas/gas heater 16, is minimized when there is combined with the normal additive a generally inert bulking agent in expanded form, such as expanded perlites, vermiculites and other mineral substances that have undergone a physical expansion when exposed to elevated temperatures. Such minerals, when heated to high flame temperatures, alter their physical characteristics by greatly expanding, in a manner reminiscent of popcorn.

The effectiveness of the use of expanded bulking agents such as expanded vermiculite in minimizing build-up is shown by the following laboratory demonstration. In each of the following samples a mixture of 30 cc of water, 3 cc of diluted sulfuric acid (5 cc concentrated sulfuric acid in 25 cc water) and 2 gm of powdered additive was observed at room temperature after stirring and after incubation at 130° C. for three hours, and gave the results set forth in Table I.

TABLE I

| Sample No. | Composition of Additive | Results: At Room Temperature after Stirring | Results: After Incubating at 130° for 3 hrs. |
|---|---|---|---|
| BB-1 | Magnesium Oxide (92%) | Settling | Hard layer-difficult to break apart. Tenacious. |
| BB-2 | 75% MgO (as in BB-1) 25% "Expanded" Vermiculite | Dispersed | Soft-easily penetrated. |
| BB-3 | 75% MgO (as in BB-1) 25% Regular-micron Vermiculite | Settled | Somewhere between BB-1 and BB-2, but on hard side, and much closer to BB-1. |
| BB-6 | 75% Lime | Milky -i.e., hard to observe if there is any degree of settlement | Crusty (somewhat moist). Tenacious. |
| BB-7 | 75% Lime 25% "Expanded" Vermiculite | Dispersed | Crushable |

From the above it will be seen that using the normal anti-corrosion alone, a tenacious adhering deposit was formed, when the normal additive was combined with unexpanded vermiculite essentially the same results were obtained, but when expanded vermiculite was used the incubated mixture could be broken up easily.

In another series of experiments the results of which are shown in Table II, samples of the type described in connection with Table I were mixed thoroughly, with the results shown in the Table. Potentially hard crusts were formed without incubation even when unexpanded vermiculite was employed, but with expanded vermiculite there was no crust; instead the mixture remained totally fluid.

TABLE II

| | Sample | Results After 15 mins. Stirring |
|---|---|---|
| 1. | MgO | A bottom hard crust. |
| 2. | MgO + expanded Vermiculite (Source 1) | Totally dispersed-homogeneous |
| 3. | MgO + expanded Vermiculite Source 2) | Totally dispersed-homogeneous |
| 4. | MgO + micron Vermiculite (Source 1) | A bottom hard crust. |
| 5. | MgO + micron Vermiculite (Source 2) | A bottom hard crust. |

The relative proportions of bulking agents and normal additives may vary widely, from 10 parts of bulking agent per 90 parts of normal additive to 90 parts of bulking agent per 10 parts of normal additive.

The total amount of normal additives and bulking agents required is based on the flow rates of the flue-gas itself and the recirculating water solution from the scrubbers 20, as well as the acidity existing in the system. Basically, the total amount to be used is determined primarily by the normal amount of usual additive that is required, but it is believed that using the bulking agent of the present invention in combination with the normal additive results in a diminution of the amount of normal additive usually required.

With a boiler of 200 megawatts, an $SO_2$ content of 6000 mg/Nm, and sulfuric acid content at the gas/gas heater of 10.5 mg/$Nm^3$, and with a treatment rate with MgO of 40–100 Kg./Hr., the following results were obtained. The acidity with the use of MgO alone as in Table I was reduced to 5.0 mg/$Nm^3$. Comparable results were obtained with lime (calcium hydroxide) at a treatment rate of 150–500 Kg./Hr., and in the case of limestone at 800–1500 Kg./Hr.

With the combination of the expanded vermiculite bulking agent, good results were obtained using only 15 Kg./Hr. of the MgO, and 5 Kg./Hr. of the bulking agent, a total of 20 Kg./Hr. for the combination, compared to 40 Kg./Hr. when using only the MgO, a reduction of 50% of the magnesium oxide, and with greatly improved cleanliness of the metal surface when both additives were used in combination.

In another example, with a treatment rate of 30 Kg./Hr. of a 25/75 blend of normal additive with an expanded vermiculite bulking agent there was a considerable reduction of the total amount of chemicals that were required, particularly when compared with the use of lime at 150 Kg./Hr., an 80% reduction, or with limestone at a rate of 800 Kg./Hr., a 96% reduction in additive rate. The extent of deposition build-up with the combination was in every case considerably less, and what build-up there was was much softer when compared to the singular use of any of the normal additives, such as lime, limestone, magnesia, or dolomite.

The most cost effective treatment rates may vary from boiler to boiler and will depend upon the megawatts of the boiler, the temperature at the inlet and outlet of the gas/gas heater, the acidity of the return flow rate from the scrubber to the gas/gas heater, the design of the gas/gas heater and the amount of sulfur dioxide and sulfuric acid present.

In actual practice, one can adjust the amounts of each additive and their relative ratios as has always been done by those versed in the art with additives generally.

The employment of the expanded substances as here described will be confirmed in and of itself, but it will also be effective when used with other additives, such as, for example, are disclosed in my earlier patents above identified.

I have called the additives of the present invention "bulking agents" because they appear to retain the bulk of the normal additives in the normal flow of materials through conduits and the system, but it may be that what those additives are doing is expanding the additives in the general flow of gas and liquids, so that the additives of the present invention might also be termed chemical expanding agents.

While a limited number of embodiments of the subject invention have been here specifically disclosed, and in particular while the use of the bulking agents has been described primarily in combination with certain specified basifying additives known to the prior art, and while the bulking agents here described appear to have particularly advantageous effects in combination with those conventional agents, it is believed that the bulking agents here described have significant value in and of themselves when used in analogous situations in flue-gas systems using other additives and even when used alone. It therefore will be apparent that many variations may be made in the details of the method here disclosed, all within the scope of the instant invention as defined in the following claims.

We claim:

1. The method for the minimization of corrosion and/or build-up of deposits on structural surfaces of a flue-gas system which are exposed to the flow of moist substances at elevated temperatures which comprises adding to said substances before said substances come into contact with said surfaces, either alone or in combination with other additives, a generally inert bulking agent in expanded form which is capable of retaining substantial quantities of water without becoming dissolved within the water to any significant degree, which method is carried out in a flue-gas system in which said moist substances pass through a section of a conduit and are then inserted into said system, said bulking agent being added to said substance up-stream of said conduit section, said flue-gas system comprising a gas/gas heater the output of which goes to a scrubber and an output of the scrubber returns to the heater, said conduit opening into said system in advance of said heater.

2. The method of claim 1, in which said bulking agent is selected from the group consisting of expanded perlites, vermiculites and other mineral substances that have undergone a substantial physical expansion when exposed to elevated temperatures.

* * * * *